United States Patent [19]

Marks

[11] 4,099,718

[45] Jul. 11, 1978

[54] RACQUET FRAME CONSTRUCTION

[75] Inventor: Nathan Marks, Englewood Cliffs, N.J.

[73] Assignee: Marcraft Recreation Inc., Garfield, N.Y.

[21] Appl. No.: 687,432

[22] Filed: May 17, 1976

[51] Int. Cl.[2] ..... A63B 49/02

[52] U.S. Cl. ..... 273/73 C; 273/73 G

[58] Field of Search ..... 273/73 R, 73 C, 73 D, 273/73 F, 73 G, 73 H, 73 K

[56] References Cited

U.S. PATENT DOCUMENTS

| | | | |
|---|---|---|---|
| 2,274,788 | 3/1942 | Hatton | 273/73 K |
| 3,083,968 | 4/1963 | Takahashi | 273/73 R |
| 3,640,533 | 2/1972 | Davis | 273/73 C |
| 3,647,211 | 3/1972 | Doessel et al. | 273/73 C |
| 3,702,701 | 11/1972 | Vaughn et al. | 273/73 H |
| 3,755,037 | 8/1973 | Erwin et al. | 273/73 F X |
| 3,787,051 | 1/1974 | Johns | 273/73 F |
| 3,810,620 | 5/1974 | Decker et al. | 273/73 C X |
| 3,986,716 | 10/1976 | Taussig et al. | 273/73 C |
| 3,990,701 | 11/1976 | Kim | 273/73 C |

FOREIGN PATENT DOCUMENTS

| | | | |
|---|---|---|---|
| 122,823 | 11/1946 | Austria | 273/73 H |
| 162,109 | 3/1955 | Austria | 273/73 K |
| 1,260,715 | 4/1961 | France | 273/73 H |
| 1,442,020 | 3/1968 | France | 273/73 H |
| 2,102,585 | 4/1972 | France | 273/73 G |
| 605,166 | 11/1934 | Fed. Rep. of Germany | 273/73 C |
| 1,065,765 | 9/1959 | Fed. Rep. of Germany | 273/73 C |
| 420,966 | 12/1934 | United Kingdom | 273/73 G |
| 734,214 | 7/1955 | United Kingdom | 273/73 J |

*Primary Examiner*—Richard J. Apley

*Attorney, Agent, or Firm*—Blum, Moscovitz, Friedman & Kaplan

[57] ABSTRACT

An improved racquet frame construction including a one-piece handle, throat and shoulder member formed of a composite material and a metal rim is provided. The shoulder of the one-piece composite material member defines two opposed shoulder-receiving portions. The respective ends of a curved metal rim are secured in the opposed shoulder-receiving portions to thereby define an improved racquet frame.

11 Claims, 5 Drawing Figures

RACQUET FRAME CONSTRUCTION

BACKGROUND OF THE INVENTION

This invention is directed to an improved racquet frame construction, and in particular to a racquet frame construction defined by a one-piece handle, throat and shoulder member formed of a composite material and a metal rim secured thereto.

While metal racquet frames for tennis, racquetball and the like have taken on various forms, the manner in which the head and handle are joined by a throat-piece has been less than completely satisfactory. For example, throat-pieces formed of fiberglass, nylon, polypropylene, ABS and/or metal in a modified geometric shape have been secured to the frame by rivets, screws, welding and other techniques. Nevertheless, the manner in which the throat-piece is joined causes unnecessary and unwanted vibration due to torqueing and other stress effects during play, which vibrational effects are directed through the frame into the handle. Moreover, the use of the throat-piece permits forward and backward flexing of the frame members causing further vibration, said vibrations rendering the playability of such racquet frames less than completely satisfactory.

SUMMARY OF THE INVENTION

Generally speaking, in accordance with the invention, a racquet frame construction is defined by a one-piece handle, throat and shoulder member. The one-piece handle, throat and shoulder member is formed of a composite material and the shoulder defines two opposed receiving portions. A curved metal rim is provided, the respective ends of the metal rim being secured in the opposed receiving portions to thereby define the racquet frame.

The composite material is a resin containing a plurality of fibers having substantially higher tensile strength than the resin.

Accordingly, it is an object of the instant invention to provide an improved racquet frame construction including a one-piece handle, throat and shoulder member.

A further object of this invention is to provide an improved racquet frame construction wherein a metal rim is joined to a one-piece handle, throat and shoulder member without riveting, screwing or welding same together.

Still a further object of the instant invention is to provide an improved racquet frame construction wherein vibration and torqueing effects are significantly reduced.

Still other objects and advantages of the invention will in part be obvious and will in part be apparent from the specification.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
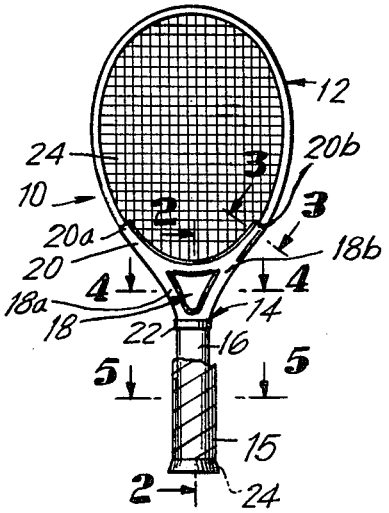
FIG. 1 is an elevational view of a racquetball racquet, with a portion of the handle removed, constructed in accordance with the preferred embodiment of the instant invention.

Reference is now made to FIG. 1, wherein a racquetball racquet constructed in accordance with a preferred embodiment of the instant invention, and generally indicated as 10, is depicted. The racquetball racquet 10 includes a metal rim 12 secured to a one-piece handle, throat and shoulder member 14.

The one-piece handle, throat and shoulder member 14 includes handle portion 16, throat portion 18 and shoulder portion 20. The handle portion is hollow and includes a first annular projection 22, which projection together with a cap 24 secured to the end of the shaft defines the lengthwise extent of the racquet handle formed by wrapping an appropriate grip material 25 around the handle portion 16 in a conventional manner. It is noted that by defining a hollow handle portion, the weight of the racquet frame is further reduced without lessening the structural integrity thereof.

The one-piece handle, throat and shoulder member is comprised of a reinforced composite material. Reinforced "composite materials" are defined as formed resins containing fibers of one or more materials having substantially higher tensile strength than the formed resin itself. Additionally, the fiber is wettable by the resin so that stresses are transferred from the resin to the fiber. Examples of such resins are polycarbonates, glass reinforced ABS, styrene acrylonitrile, polyethylene, polypropylene, polysulfone, nylon and epoxy. Examples of the fibers are carbon, graphite, Boron high modulus glass, and any mixture thereof.

It is further noted that the fibers are frequently termed "whiskers" and are usually single crystals except in the case of glass fibers. Such single crystals as well as glass fibers are relatively free of flaws and have tensile strengths that may be as much as ten times as great as that of the material when the material is prepared by other means such as casting or rolling. Graphite as well as glass fibers are preferred examples of such high strength materials. Accordingly, it is well known in the art that reinforced composite materials are far superior in strength to the plastic resin alone since each individual fiber has greater tensile strength than the resin itself and the embedded fibers serve to absorb a major portion of any stresses applied. Moreover the presence of the resin joining the fiber insures that stresses will be distributed over a larger number of fibers.

Figure 2:
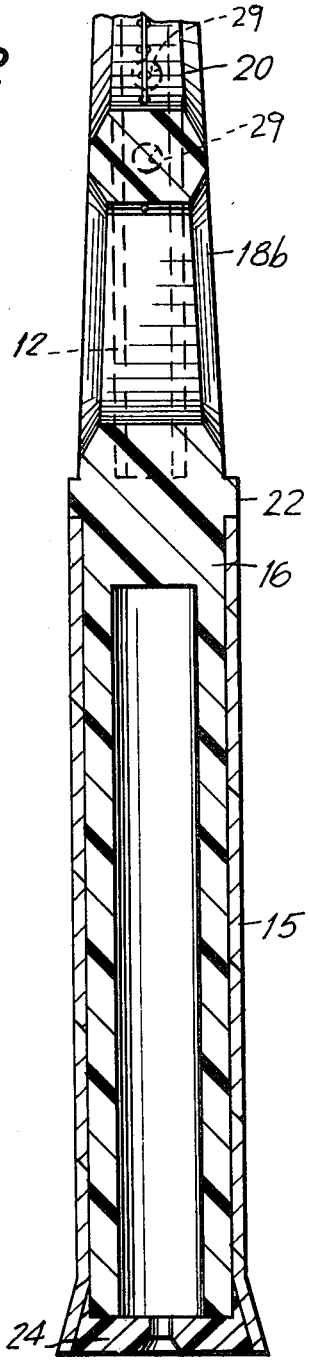
FIG. 2 is a partial sectional view taken along line 2—2 of FIG. 1.
Figure 3:
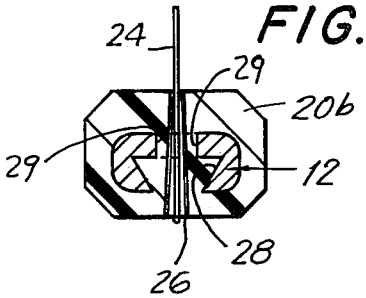
FIG. 3 is a sectional view taken along line 3—3 of FIG. 1.
Figure 4:
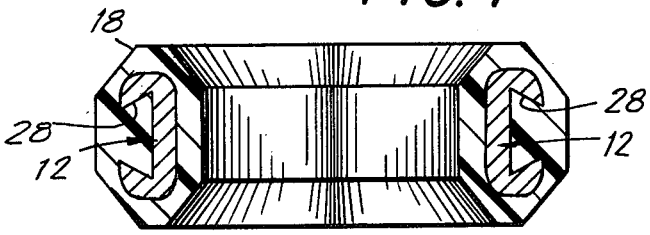
FIG. 4 is a sectional view taken along line 4—4 of FIG. 1.
Figure 5:
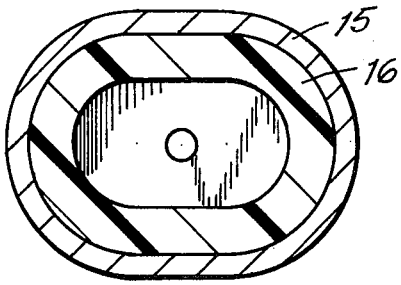
FIG. 5 is a sectional view taken along line 5—5 of FIG. 1.

The metal rim, preferably formed of a high strength aluminum or aluminum alloy is secured at the ends thereof to at least the extended shoulder portions **20*a* and 20*b* of the shoulder portion 20 and additionally as indicated by the dotted lines in FIG. 2, into the respective throat struts 18*a* and 18*b*. The rim 12 is provided with a plurality of openings 29 along the length thereof for receiving and holding stringing 23 in the exposed portion of same and for receiving the composite material in the portions of the rim embedded in the extended shoulder portions and throat struts of member 14. As is illustrated in FIG. 3 in each of the openings 29 disposed in the portion of the rim embedded in the extended shoulder portions 20***a* and 20*b*, an elongated opening 26 is provided therethrough for receiving the stringing 23. Accordingly, the remainder of the opening 29 is filled with the composite material when the rim is secured in the one-piece composite handle throat and shoulder member by injection molding, thereby anchoring the ends of the rim 12 at least in the extended shoulder portions 20*a* and 20*b* to thereby define the racquet frame. The rim 12 is formed with an undercut 28 for further securing the rim in the shoulder portion 20 of the one-piece member 14.

As noted above, by securing the rim to the extended shoulder portion by integrally forming the shoulder portion by injection molding the one-piece member 14 about the rim, within the string-receiving openings in the rim, and within the undercut defined by the rim, a racquet frame wherein the rim is free of any tendency to pull free from the handle as a result of the difference in thermal coefficient of expansion between metal and organic resin is obtained. Furthermore, as the resin is molded about the metal rim, the ensuing contraction during cooling subsequent to molding provides a permanently tight join therebetween.

The instant invention although described as a racquetball frame, is not limited thereto. It is noted that tennis racquet frames can also be formed in accordance with the instant invention by providing an elongated one-piece handle, throat and shoulder member to obtain the same benefits ascribed to the racquetball frame described above.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A racquet frame construction comprising in combination a one-piece handle, throat and shoulder member consisting essentially of a composite material, said shoulder of said one-piece member defining two opposed receiving means, and a curved metal rim, the respective ends of said metal rim being secured in said receiving means to thereby define said racquet frame.

2. A racquet frame construction as claimed in claim 1, wherein said composite material is a resin containing a plurality of fibers of an additional material having substantially higher tensile strength than said resin.

3. A racquet frame construction as claimed in claim 2, wherein said additional fibers are selected from the group consisting of carbon, graphite, Boron high modolus glass and mixtures thereof.

4. A racquet frame construction as claimed in claim 2, wherein said resin is selected from the group consisting of polycarbonate, glass reinforced ABS, styrene acrylo nytril, polyethylene, polypropylene, epoxy, polysulfone, nylon and mixtures thereof.

5. A racquet frame as claimed in claim 2, wherein said frame is secured to said one-piece composite material handle throat and shoulder member by injection molding said handle throat and shoulder member about said rim.

6. A racquet frame as claimed in claim 2, wherein said metal rim includes a plurality of string receiving openings disposed along the lengthwise extent of said rim, at least one of said openings in each end of said rim disposed in said receiving means of said one-piece member having said composite material forming said one-piece member disposed in at least a portion thereof.

7. A racquet frame as claimed in claim 6, wherein said composite material disposed in the openings in said rim define a string receiving opening in said rim and one-piece member.

8. A racquet frame as claimed in claim 7, wherein at least said portion of the rim disposed in said shoulder receiving means is cross-sectioned to define an undercut for providing structural rigidity to the join of said rim to said one-piece member.

9. A racquet frame as claimed in claim 8, wherein said frame is secured to said one-piece composite material handle throat and shoulder member by injection molding said handle throat and shoulder member about said rim.

10. A racquet frame construction comprising in combination a one-piece handle throat and shoulder member comprised of a synthetic material, said shoulder of said one-piece member defining two opposed receiving means, and a curved metal rim, including a plurality of string receiving openings disposed along the lengthwise extent of said rim, at least one of said openings in each end of said rim disposed in said receiving means of said one-piece member having said synthetic material forming said one-piece member disposed in at least a portion of said opening, for securing said rim in said receiving means.

11. The racquet frame construction as claimed in claim 10, wherein said synthetic material disposed in the openings in the rim define string receiving openings.

* * * * *